US008403155B1

(12) United States Patent
Kao

(10) Patent No.: US 8,403,155 B1
(45) Date of Patent: Mar. 26, 2013

(54) HAND TOOL FRAME

(76) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 13/331,043

(22) Filed: Dec. 20, 2011

(51) Int. Cl.
*A47F 7/00* (2006.01)
*B65D 85/28* (2006.01)

(52) U.S. Cl. ..... 211/70.6; 206/376

(58) Field of Classification Search ..... 211/70.6, 211/60.1, 69; 248/220.21, 223.41; 206/376, 206/372, 483, 480, 477
See application file for complete search history.

(56) References Cited

U.S. PATENT DOCUMENTS

| | | | | | |
|---|---|---|---|---|---|
| 4,705,168 | A * | 11/1987 | Ward | 206/373 |
| 5,346,063 | A * | 9/1994 | Chow | 206/376 |
| 5,505,316 | A * | 4/1996 | Lee | 211/70.6 |
| 5,645,177 | A * | 7/1997 | Lin | 211/70.6 |
| 5,941,386 | A * | 8/1999 | Hu et al. | 206/376 |
| D415,913 | S * | 11/1999 | Ernst | D6/512 |
| 6,039,178 | A * | 3/2000 | Ernst | 206/376 |
| 6,315,121 | B1 * | 11/2001 | Hansen | 206/376 |
| 6,386,363 | B1 * | 5/2002 | Huang | 206/378 |
| 6,401,923 | B1 * | 6/2002 | Huang | 206/376 |
| 6,536,611 | B2 * | 3/2003 | Chen | 211/70.6 |
| 6,976,582 | B2 * | 12/2005 | Chen | 206/376 |
| 7,178,670 | B2 * | 2/2007 | Chen | 206/376 |
| 7,537,124 | B2 * | 5/2009 | Chen | 211/70.6 |
| 7,584,845 | B2 * | 9/2009 | Cheng | 206/376 |
| 7,815,058 | B2 * | 10/2010 | Cheng | 211/70.6 |
| 7,987,975 | B1 * | 8/2011 | Lee | 206/45.23 |
| 7,987,981 | B1 * | 8/2011 | Lee | 206/376 |
| 8,069,995 | B2 * | 12/2011 | Winnard | 211/70.6 |
| 8,152,003 | B1 * | 4/2012 | Kao | 211/70.6 |
| 8,286,807 | B2 * | 10/2012 | Winnard | 211/70.6 |
| 2002/0121491 | A1 * | 9/2002 | Ernst | 211/70.6 |
| 2005/0098461 | A1 * | 5/2005 | Kao | 206/372 |
| 2005/0173279 | A1 * | 8/2005 | Chen | 206/372 |
| 2007/0023369 | A1 * | 2/2007 | Lin | 211/70.6 |
| 2008/0156754 | A1 * | 7/2008 | Cheng | 211/70.6 |
| 2009/0218302 | A1 * | 9/2009 | Winnard | 211/70.6 |
| 2010/0065522 | A1 * | 3/2010 | Cheng | 211/85.8 |
| 2010/0163502 | A1 * | 7/2010 | Chang | 211/70.6 |
| 2010/0258515 | A1 * | 10/2010 | Chen | 211/70.6 |
| 2012/0111814 | A1 * | 5/2012 | Kao | 211/70.6 |
| 2012/0138497 | A1 * | 6/2012 | Lee | 206/376 |
| 2012/0305506 | A1 * | 12/2012 | Su | 211/70.6 |

* cited by examiner

*Primary Examiner* — Joshua J Michener
*Assistant Examiner* — Devin Barnett
(74) *Attorney, Agent, or Firm* — patenttm.us

(57) ABSTRACT

A hand tool frame has a baseboard, two clamping elements and multiple positioning elements. The baseboard has a body and a hanging panel. The hanging panel is connected to the top of the body and has a hanging hole. The clamping elements are mounted on the baseboard and each clamping element has a clamping panel. Each clamping panel has multiple clamping claws and multiple inserting holes. The positioning elements are mounted on the baseboard at intervals between the clamping elements with the same sizes and each positioning element has an elastic arm. The elastic arm is formed on and protrudes from the body and has a curved segment and a limiting segment. The limiting segment is formed on and protrudes from the curved segment to abut against a hand tool.

7 Claims, 12 Drawing Sheets

HAND TOOL FRAME

BACKGROUND OF THE INVENTION

1. Field of the Invention

The present invention relates to a tool frame, and more particularly to a hand tool frame that can be used to hold hand tools of different sizes conveniently.

2. Description of the Prior Art

A conventional hand tool frame is used to hold or store hand tools such as wrenches and has a baseboard, two clamping panels and multiple pressing bars. The baseboard has a top, a front side and a hanging hole. The hanging hole is formed through the baseboard near the top of the baseboard. The clamping panels are formed on and protrude from the front side of the baseboard at an interval below the hanging hole and parallel each other. Each clamping panel has a front side, multiple clamping claws and multiple inserting holes. The clamping claws are formed in the front side of the clamping panel at intervals and have different sizes. The inserting holes are formed in the front side of the clamping panel between the clamping claws and have different sizes. The inserting holes of the clamping panels align with each other. The pressing bars are formed on and protrude from the front side of the baseboard at intervals between the clamping panels and align with the inserting holes of the clamping panels. The sizes of the pressing bars are corresponding to the sizes of the inserting holes of the clamping panels.

In use, two ends of a hand tool are respectively mounted in two of the inserting holes of the clamping panels of the conventional hand tool frame between the adjacent clamping claws and press against one of the pressing bars this is formed between the corresponding inserting holes of the clamping panels.

However, the clamping claws of the clamping panels have specific sizes and the pressing bars are securely formed on the baseboard to fit with the specific sizes of the inserting holes of the clamping panels. The inserting holes of the clamping panels of the conventional hand tool frame only can be used to hold the hand tools of specific sizes and cannot be fit with hand tools of different sizes. Then, the user may need to buy multiple conventional hand tool frames of multiple different sizes to hold or store hand tools and this is inconvenient in use and will limit the practicability of the conventional hand tool frame.

To overcome the shortcomings, the present invention tends to provide a hand tool frame to mitigate the aforementioned problems.

SUMMARY OF THE INVENTION

The main objective of the present invention is to provide a hand tool frame that can be used to hold different sizes of hand tools conveniently.

The hand tool frame in accordance with the present invention has a baseboard, two clamping elements and multiple positioning elements. The baseboard has a body and a hanging panel. The hanging panel is connected to the top of the body and has a hanging hole. The clamping elements are mounted on the baseboard and each clamping element has a clamping panel. Each clamping panel has multiple clamping claws and multiple inserting holes. The positioning elements are mounted on the baseboard at intervals between the clamping elements with the same sizes and each positioning element has an elastic arm. The elastic arm is formed on and protrudes from the body and has a curved segment and a limiting segment. The limiting segment is formed on and protrudes from the curved segment to abut against a hand tool.

Other objects, advantages and novel features of the invention will become more apparent from the following detailed description when taken in conjunction with the accompanying drawings.

DETAILED DESCRIPTION OF THE PREFERRED EMBODIMENT

Figure 1:
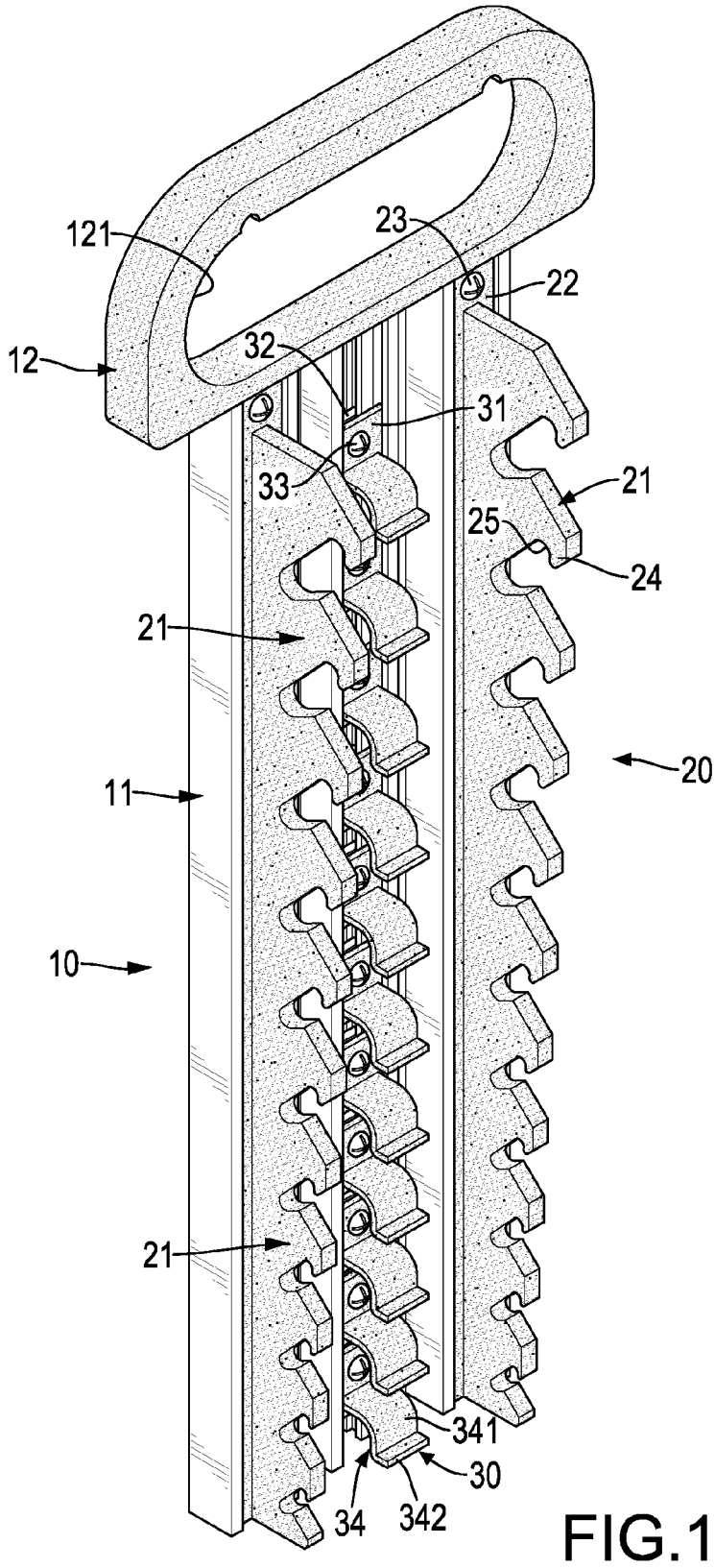
FIG. 1 is a perspective view of a first embodiment of a hand tool frame in accordance with the present invention.
Figure 7:
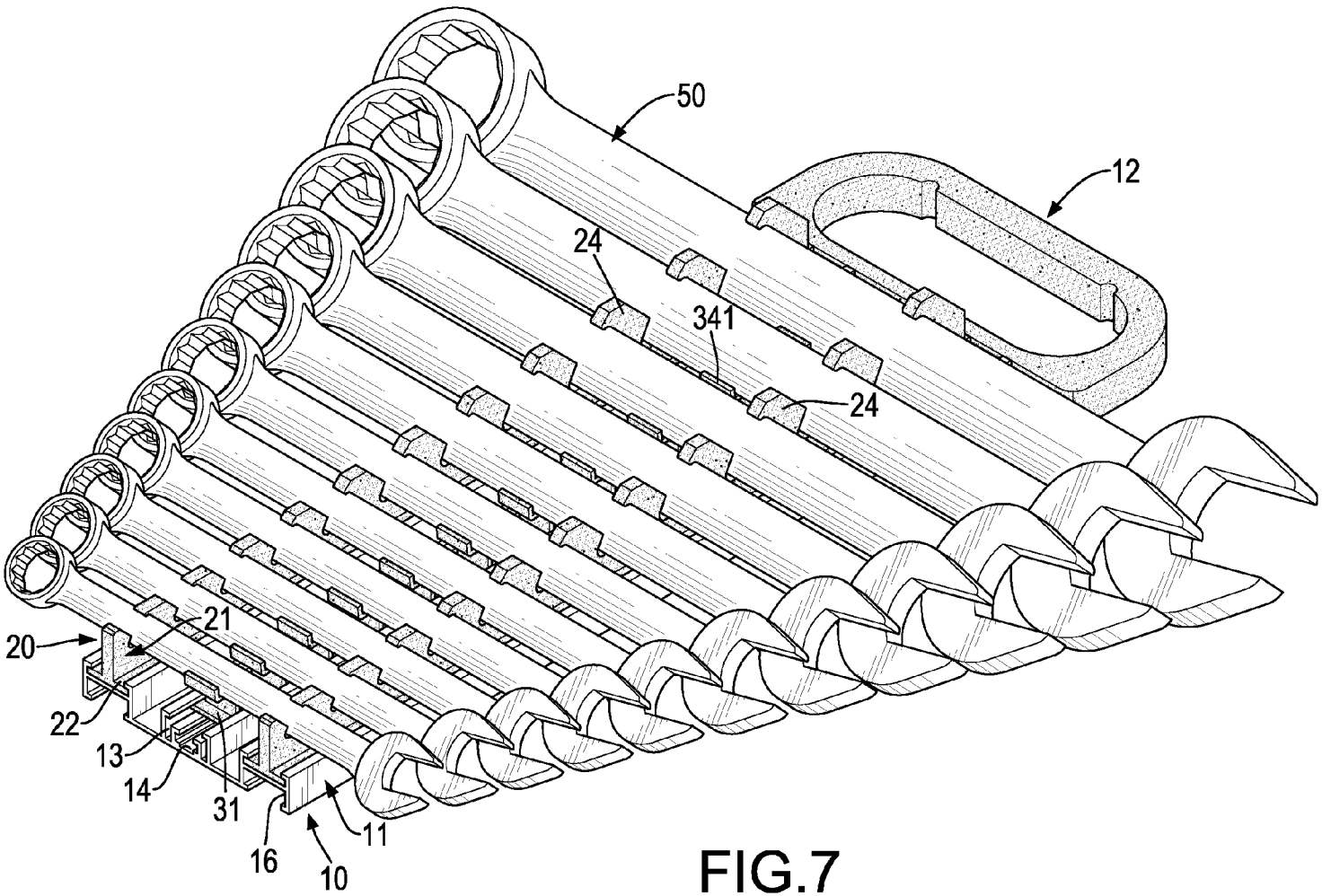
FIG. 7 is an operational perspective view of the hand tool frame in FIG. 1, showing hand tools clamped by the hand tool frame.
Figure 11:
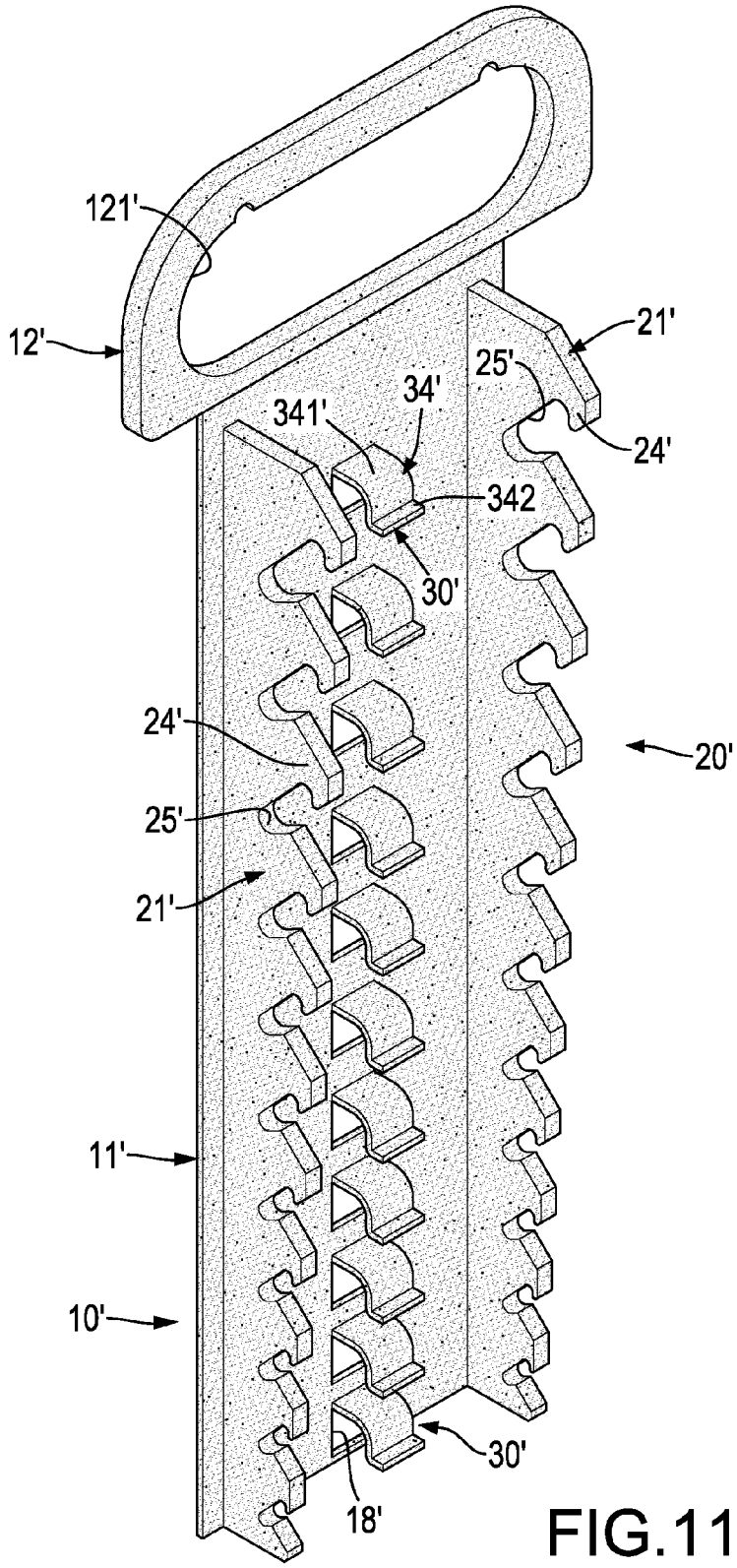
FIG. 11 is a perspective view of a second embodiment of a hand tool frame in accordance with the present invention.

With reference to FIGS. 1, 7 and 11, a hand tool frame in accordance with the present invention for holding hand tools such as wrenches 50 has a baseboard 10, 10', two clamping elements 20, 20' and multiple positioning elements 30, 30'.

Figure 2:
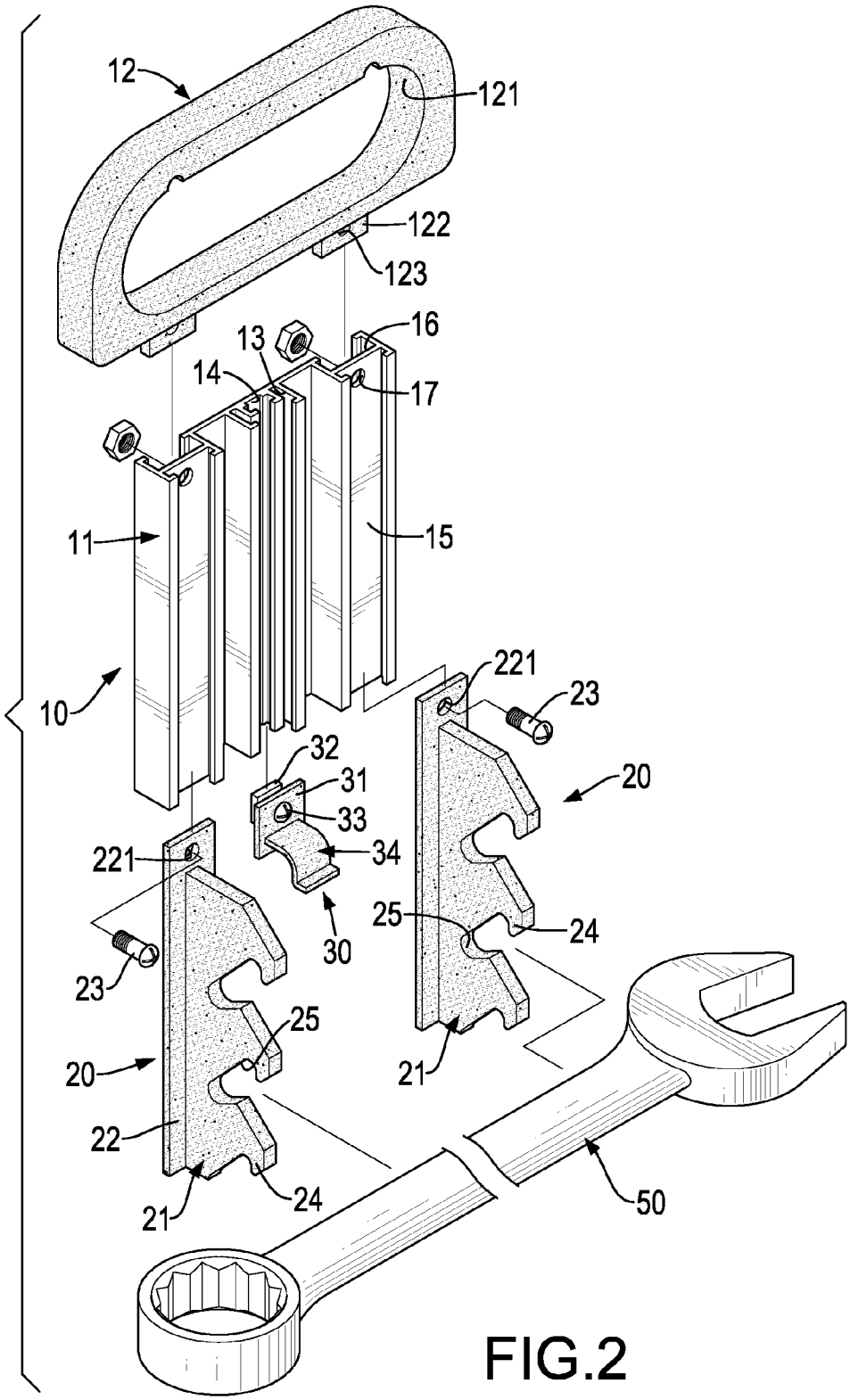
FIG. 2 is an exploded perspective view of the hand tool frame in FIG. 1.
Figure 3:
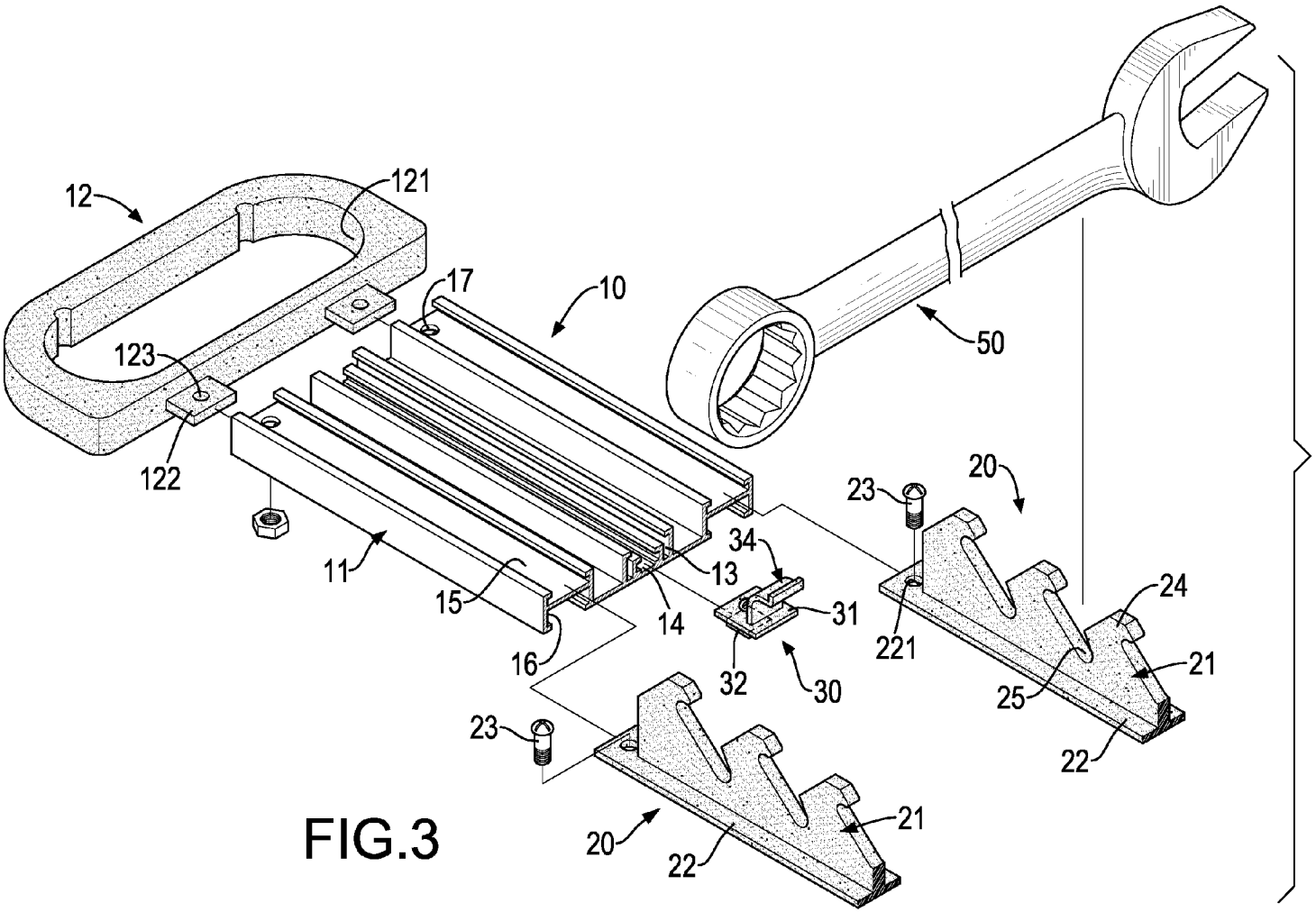
FIG. 3 is another exploded perspective view of the hand tool frame in FIG. 1.
Figure 6:
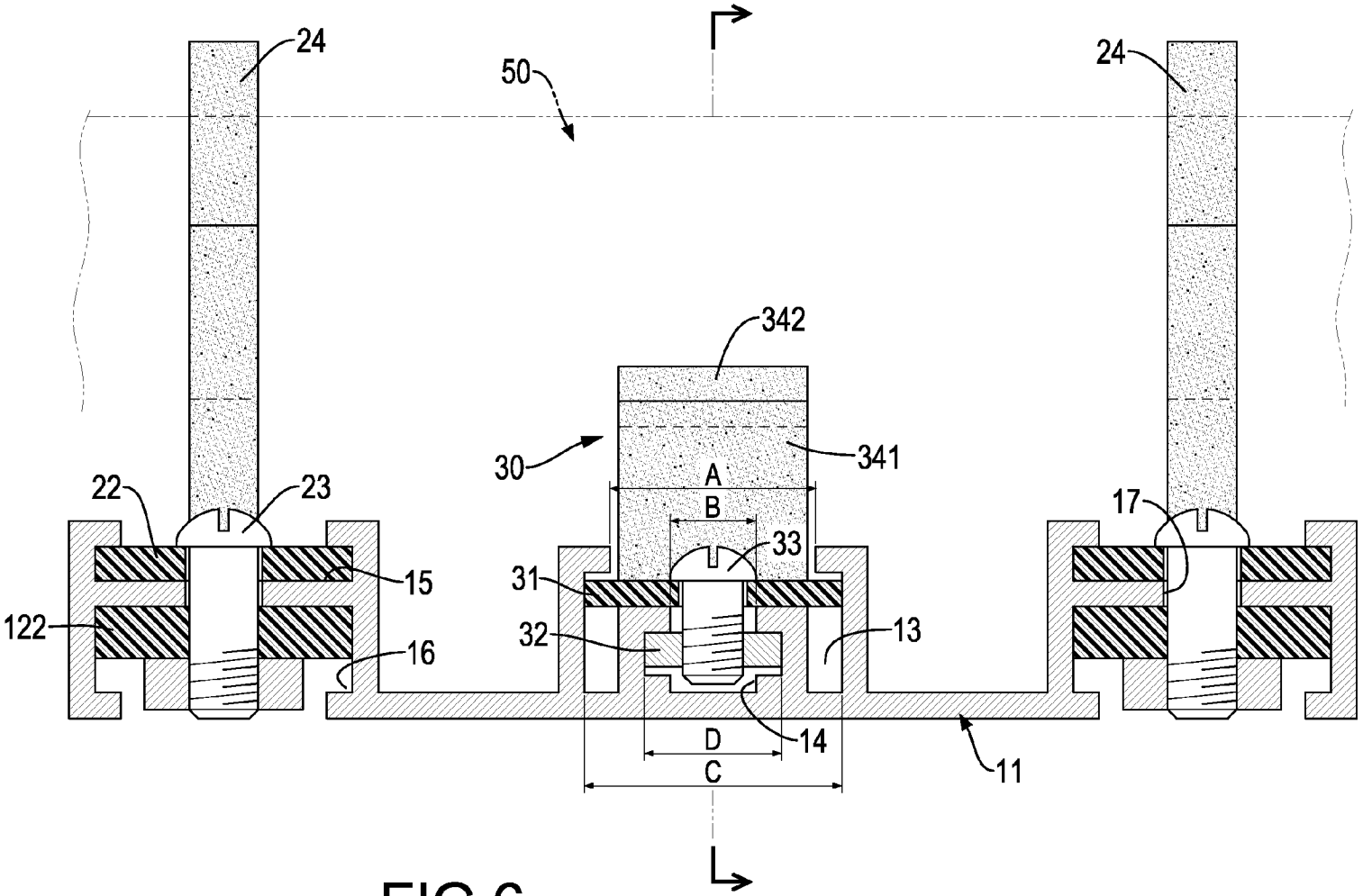
FIG. 6 is an enlarged side view in partial section of the hand tool frame along line 6-6 in FIG. 5.

The baseboard 10, 10' has a body 11, 11' and a hanging panel 12, 12'. The body 11, 11' is rectangular and has a front side, a rear side, a top and a bottom. With reference to FIGS. 2 and 3, the body 11 of the first embodiment of the hand tool frame further has an outer rack 13, an inner rack 14, two front mounting recesses 15, two rear mounting recesses 16 and two passing holes 17. The outer rack 13 is formed on the front side of the body 11 from the top to the bottom of the body 11 and has a front side and an opening. The opening of the outer rack 13 is formed through the front side of the outer rack 13 and has a width (A) as shown in FIG. 6.

The inner rack 14 is formed on the front side of the body 11 from the top to the bottom of the body 11, is located in the outer rack 13 and has a front side and an opening. The opening of the inner rack 14 is formed through the front side of the inner rack 14 and has a width (B) as shown in FIG. 6. The front mounting recesses 15 are formed in the front side of the body 11 beside the outer rack 13 and parallel the outer rack 13. The rear mounting recesses 16 are formed in the rear side of the body 11 corresponding to the front mounting recesses 15. The passing holes 17 are formed through the sides of the body 11 near the top of the body 11 and respectively communicate with the front mounting recesses 15 and the rear mounting recesses 16. With reference to FIG. 11, the body 11' of the second embodiment of the hand tool frame has multiple open holes 18' formed through the sides of the body 11' at intervals.

The hanging panel 12, 12' is connected to the top of the body 11, 11' and has a hanging hole 121, 121' formed through the hanging panel 12, 12'. With reference to FIGS. 2 and 3, the hanging panel 12 is detachably connected to the top of the body 11 and further has a bottom side and two connecting blocks 122. The connecting blocks 122 are formed on and protrude from the bottom side of the hanging panel 12 at an interval and are respectively mounted in the rear mounting recesses 16 of the body 11. Each connecting block 122 has a connecting hole 123 formed through the connecting block 122 and aligning with the passing hole 17 that communicates with the corresponding rear mounting recess 16. With reference to 11 and 12, the hanging panel 12' is securely formed on the top of the body 11'.

Figure 12:
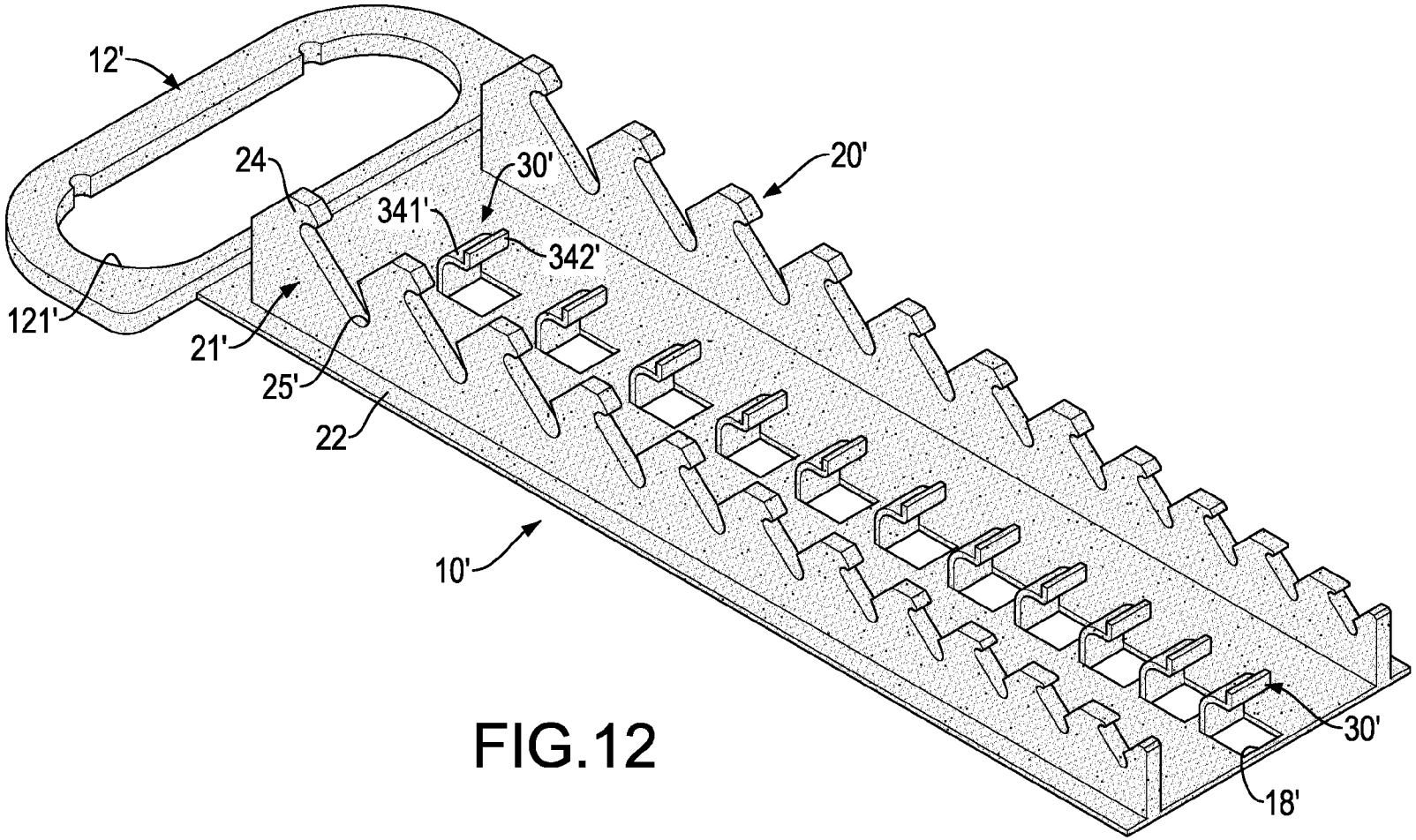
FIG. 12 is another perspective view of the hand tool frame in FIG. 11.

The clamping elements 20, 20' are mounted on the baseboard 10, 10'. With reference to FIGS. 11 and 12, the clamping elements 20' are securely formed on and protrude from the body 11' of the baseboard 10' beside the open holes 18', and each clamping element 20' has a clamping panel 21'. The hanging panels 21' are perpendicularly formed on and protrude from the front side of the body 11' from the top to the bottom of the body 11' beside the open holes 18'.

With reference to FIGS. 2 and 3, the clamping elements 20 are detachably mounted on the body 11 of the baseboard 10 beside the outer rack 13, and each clamping element 20 has a connecting panel 22, a fastener 23 and a clamping panel 21. The connecting panel 22 is mounted in one of the front mounting recesses 15 and has a top and a through hole 221. The through hole 221 is formed through the connecting panel 22 near the top of the connecting panel 22 and aligns with the passing hole 17 that communicates with the corresponding front mounting recess 15. With reference to FIG. 6, the fastener 23 is mounted through the through hole 221 of the connecting panel, the corresponding passing hole 17 and the connecting hole 123 of the corresponding connecting block 122 to connect the connecting panel 22 and the connecting block 122 with the body 11. Then, the hanging panel 12 is securely connected to the top of the body 11 and the connecting panel 22 of the clamping element 20 is securely mounted on the front side of the body 11. The clamping panel 21 is perpendicularly formed on and protrudes from the connecting panel 22 and extends out of the corresponding front mounting recess 15.

With reference to FIGS. 1 and 11, each clamping panel 21, 21' has a front side, multiple clamping claws 24, 24' and multiple inserting holes 25, 25'. The front side of the clamping panel 21 extends out of the corresponding front mounting recess 15. The clamping claws 24, 24' are formed in the front side of the clamping panel 21, 21' at intervals and have different sizes. The inserting holes 25, 25' are formed in the front side of the clamping panel 21, 21' between the clamping claws 24, 24'. The inserting holes 25, 25' of the clamping panels 21, 21' align with each other.

The positioning elements 30, 30' are mounted on the baseboard 10, 10' at intervals between the clamping elements 20, 20' and have the same sizes. With reference to FIGS. 11 and 12, each positioning element 30' is securely formed on and protrudes from the front side of the body 11' and aligns with two corresponding inserting holes 25' of the two clamping elements 20'. Preferably, each positioning element 30' is formed on and protrudes from the front side of the body 11' adjacent to one of the open holes 18' of the body 11'.

Figure 4:
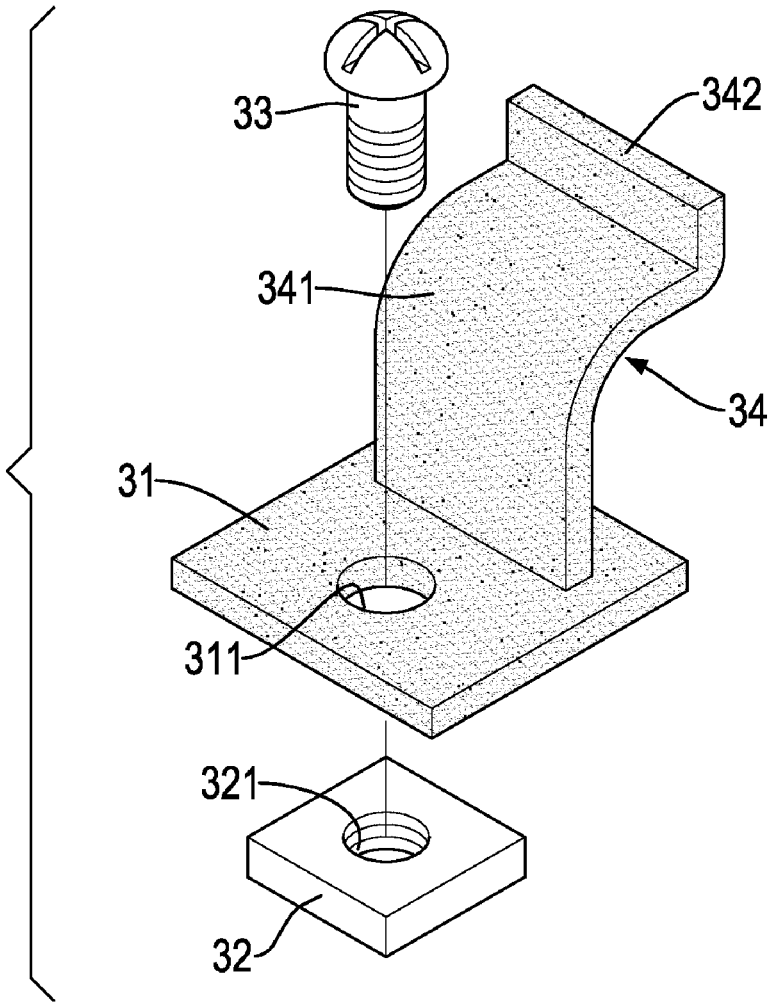
FIG. 4 is an enlarged and exploded perspective view of a positioning element of the hand tool frame in FIG. 1.
Figure 5:
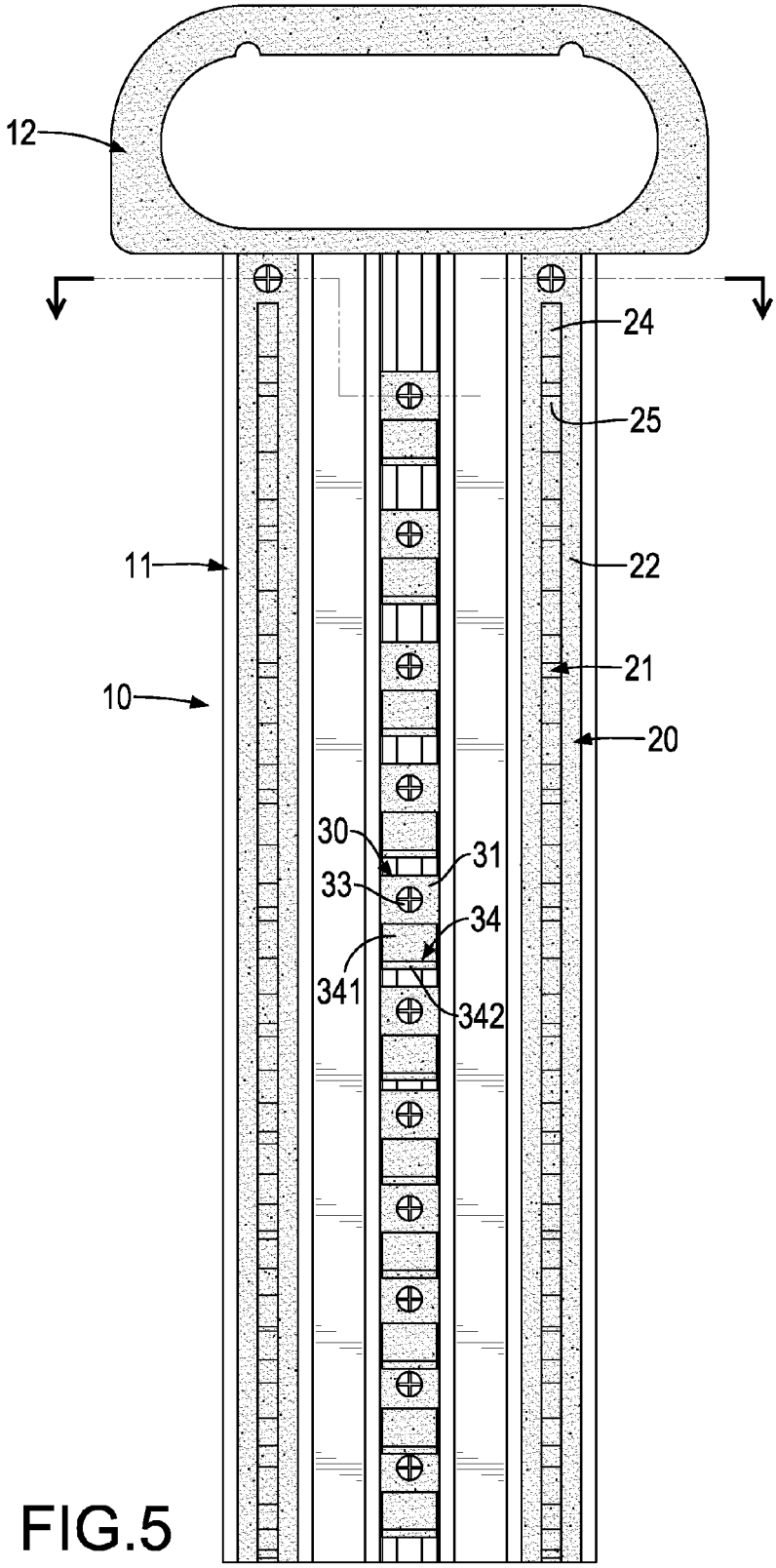
FIG. 5 is a front side view of the hand tool frame in FIG. 1.

With reference to FIGS. 4, 5 and 6, each positioning element 30 is movably mounted between the racks 13, 14 of the body 11 and has a bottom board 31, a fixing board 32, a screw bolt 33 and an elastic arm 34. The bottom board 31 is quadrate, is movably mounted in the outer rack 13 of the body 11 and has a width (C) and a bottom hole 311. With reference to FIG. 6, the width (C) of the bottom board 31 is wider than the width (A) of the opening of the outer rack 13. Then, the bottom board 31 cannot be separated from the outer rack 13 via the opening of the outer rack 13. The bottom hole 311 is formed through the bottom board 31 and communicates with the inner rack 14 via the opening of the inner rack 14.

The fixing board 32 is quadrate, is movably mounted in the inner rack 14 of the body 11 below the bottom board 31 and has a width (D) and a fixing hole 321. With reference to FIG. 6, the width (D) of the fixing board 32 is wider than the width (B) of the opening of the inner rack 14. Then, the fixing board 32 cannot be separated from the inner rack 14 via the opening of the inner rack 14. The fixing hole 321 is formed through the fixing board 31 and aligns with the bottom hole 311 of the bottom board 31 via the opening of the inner rack 14. The screw bolt 33 is mounted through the bottom hole 311 of the bottom board 31 via the opening of the outer rack 13 and is securely mounted in the fixing hole 321 of the fixing board 32 via the opening of the inner rack 14 to connect the bottom board 31 securely with the fixing board 32 between the racks 13, 14.

With reference to FIG. 4, the elastic arm 34 is formed on and protrudes from the bottom board 31, extends out of the outer rack 13 via the opening of the outer rack 13 and has a curved segment 341 and a limiting segment 342. The curved segment 341 is curvedly formed on and protrudes from the bottom board 31 and has a free end extended out of the outer rack 13 via the opening of the outer rack 13. The limiting segment 342 is formed on and protrudes from the free end of the curved segment 341 of the elastic arm 34 to abut against a wrench 50.

With reference to FIGS. 11 and 12, the elastic arm 34' of the positioning element 30' is formed on and protrudes from the front side of the body 11' over a corresponding open hole 18' of the body 11' and has a curved segment 341' and a limiting segment 342'. The curved segment 341' is curvedly formed on and protrudes from front side of the body 11' and has a free end extended over the corresponding open hole 18' of the body 11'. The limiting segment 342' is formed on and protrudes from the free end of the curved segment 341' of the elastic arm 34' to abut against a wrench 50.

Figure 8:
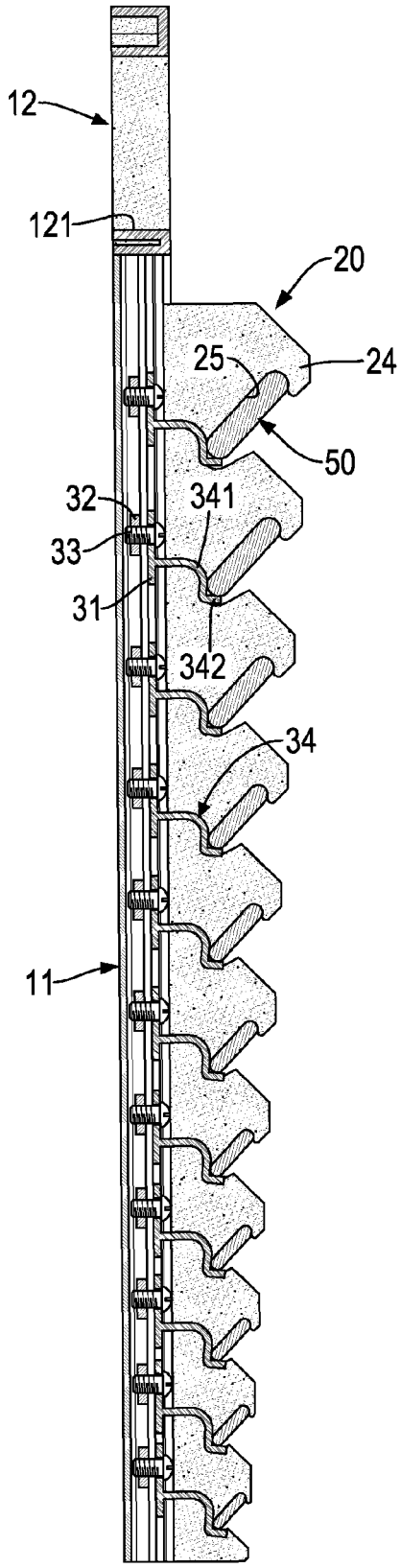
FIG. 8 is an operational side view in partial section of the hand tool frame in FIG. 7.

With reference to FIGS. 7 and 8, when the first embodiment of the hand tool frame in accordance with the present invention is used to hold or store hand tools, two ends of a wrench 50 are respectively mounted in two inserting holes 25 of the clamping panels 21 of the clamping elements 20. With reference to FIGS. 4 and 6, the screw bolt 33 of one of the positioning elements 30 is loosen to form a gap between the corresponding bottom board 31, the corresponding fixing board 32 and the inner rack 14. Then, the bottom board 31 and the fixing board 32 can be respectively moved relative to the outer rack 13 and the inner rack 14 to enable the limiting segment 342 of the elastic arm 34 of the corresponding positioning element 30 to abut against the wrench 50. After the elastic arm 34 abuts against the wrench 50, the screw bolt 33 is fastened to enable the bottom board 31 and the fixing board 32 to press against the inner rack 14 and this can enable the corresponding positioning element 30 to securely mount on the body 11 to abut against the wrench 50. Then, the wrench 50 can be securely and conveniently held on the hand tool frame between the corresponding inserting holes 25 by the corresponding positioning element 30 and the corresponding clamping claws 24.

Figure 9:
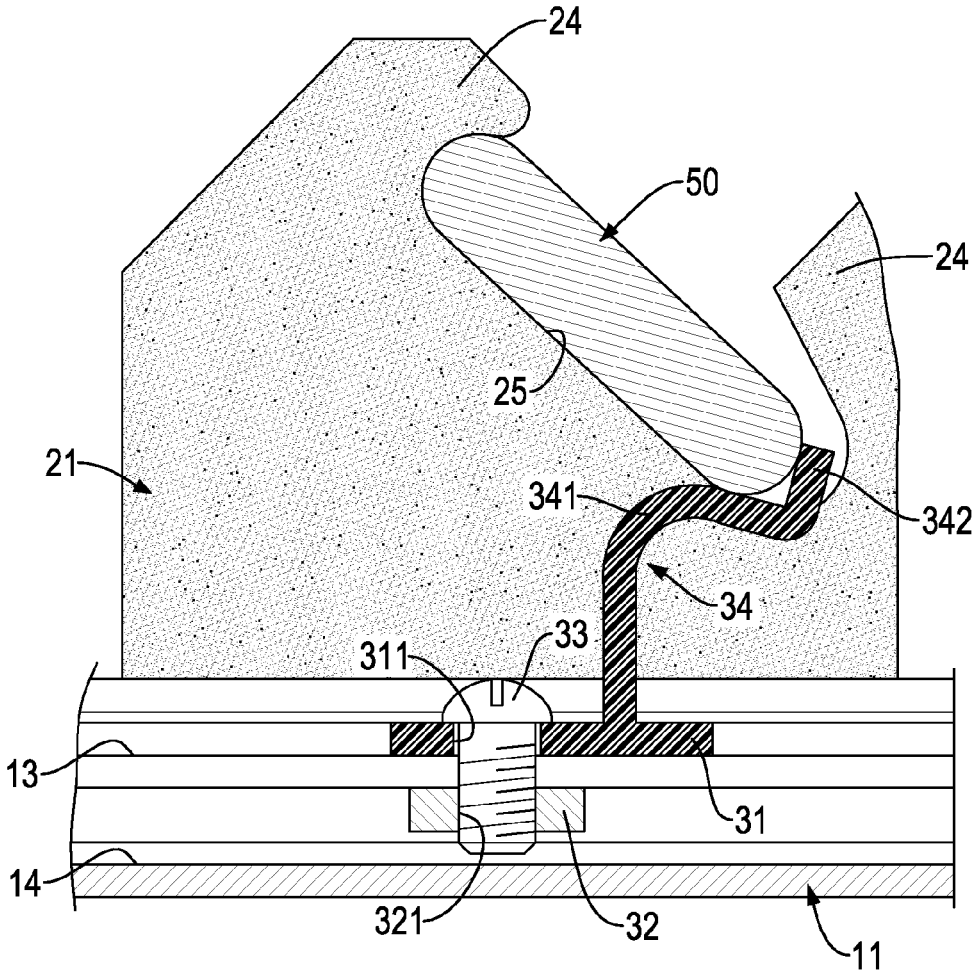
FIG. 9 is an enlarged and operational side view of the hand tool frame along line 9-9 in FIG. 6.
Figure 10:
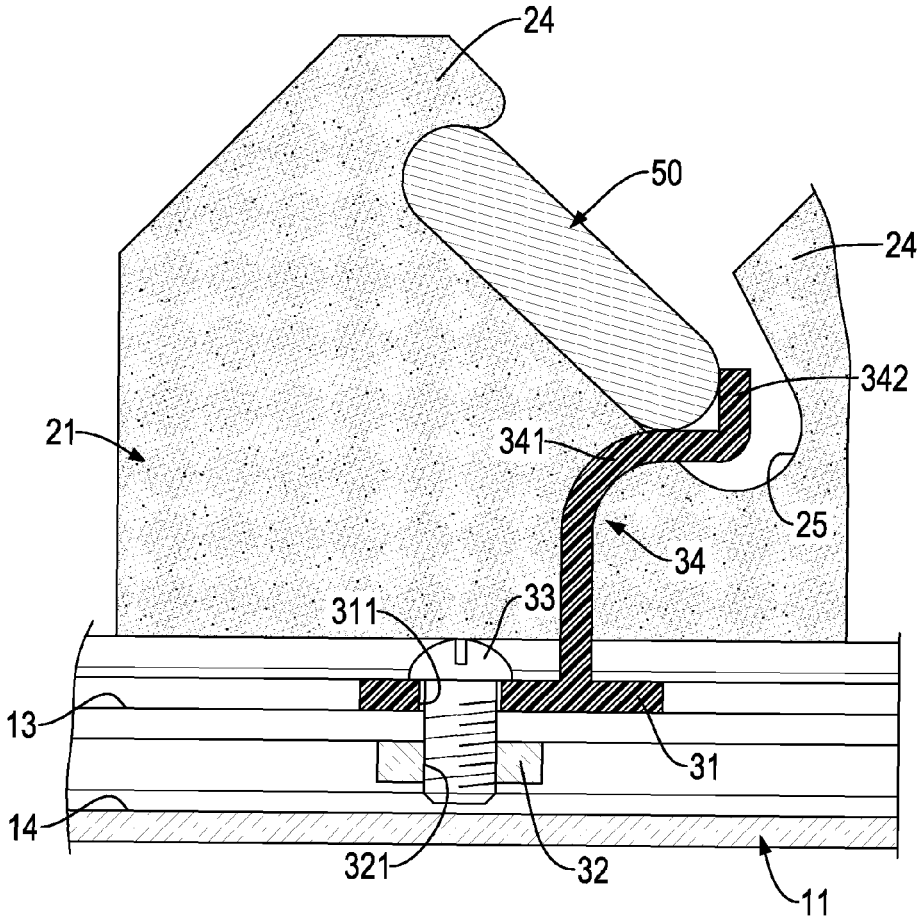
FIG. 10 is another enlarged and operational side view of the hand tool frame in FIG. 6.

In addition, with reference to FIGS. 9 and 10, when wrenches 50 of different sizes are mounted on the hand tool frame, the position of the elastic arm 34 of each one of the positioning elements 30 can be adjusted by loosening a corresponding screw bolt 33 and moving the boards 31, 32 relative to the racks 13, 14 of the body 11 to enable the elastic arm 34 to move close to and abut against a corresponding wrench 50. Furthermore, the curved segment 341 of the elastic arm 34 can be elastic deformed to closely abut against a corresponding wrench 50. Then, the wrenches 50 of different sizes can be securely held on the hand tool frame in the inserting holes 25 between the clamping claws 24 of the clamping panels 21 and the positioning elements 30.

With reference to FIGS. 11 and 12, when the second embodiment of the hand tool frame in accordance with the present invention is used to hold or store wrenches 50 of different sizes, the elastic arms 34' of the positioning elements 30' can be elastically deformed to abut against the wrenches 50 of different sizes. Then, the wrenches 50 of different sizes can be securely held on the hand tool frame in the inserting holes 25' between the clamping claws 24' of the clamping panels 21' and the positioning elements 30'.

According to the above-mentioned statement, the elastic arms 34, 34' of the positioning elements 30, 30' have characteristics of elastic deformation, and this can be used to hold hand tools of different sizes securely on the hand tool frame in the inserting holes 25, 25' between the clamping claws 24, 24' and the elastic arms 34, 34'. Furthermore, the positioning elements 30 can be moved relative to the body 11 of the baseboard 10 and this can enable the elastic arms 34 of the positioning elements 30 to abut against the hand tools closely to provide a preferred connecting effect to the hand tools. In addition, the bottom boards 31 and the fixing boards 32 of the positioning elements 30 are quadrate and this can respectively enable the bottom boards 31 and the fixing boards 32 to move relative to the outer rack 13 and the inner rack 14 of the baseboard 10 without rotating. Then, the elastic arms 34 of the positioning elements 30 can abut against the hand tools at the same direction. Additionally, each positioning elements 30, 30' has the same size and this can enable to manufacture the positioning elements 30, 30' simplified.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand tool frame comprising:
a baseboard having
a body having
a front side;
a rear side;
a top; and
a bottom;
an outer rack formed on the front side of the body from the top to the bottom of the body and having
a front side; and
an opening formed through the front side of the outer rack and having a width; and
an inner rack formed on the front side of the body from the top to the bottom of the body in the outer rack and having
a front side; and
an opening formed through the front side of the inner rack and having a width;
a hanging panel detachably connected to the top of the body and having a hanging hole formed through the hanging panel;
two clamping elements mounted on the front side of the body of the baseboard, and each clamping element having
a clamping panel mounted on the front side of the body of the baseboard and having
a front side;
multiple clamping claws formed in the front side of the clamping panel at intervals and having different sizes; and
multiple inserting holes formed in the front side of the clamping panel between the clamping claws and aligning with the inserting holes of the other clamping panel; and
multiple positioning elements with a same size movably mounted between the racks of the body and each having
a bottom board movably mounted in the outer rack of the body and having
a width; and
a bottom hole formed through the bottom board and communicating with the inner rack via the opening of the inner rack;
a fixing board movably mounted in the inner rack of the body below the bottom board and having
a width; and
a fixing hole formed through the fixing board and aligning with the bottom hole of the bottom board via the opening of the inner rack;
a screw bolt mounted through the bottom hole of the bottom board via the opening of the outer rack and securely mounted in the fixing hole of the fixing board via the opening of the inner rack to connect the bottom board securely with the fixing board between the racks; and
an elastic arm formed on and protruding from the bottom board, extending out of the outer rack via the opening of the outer rack and having
a curved segment curvedly formed on and protruding from the bottom board and having a free end extended out of the outer rack via the opening of the outer rack; and
a limiting segment formed on and protruding from the free end of the curved segment of the elastic arm to abut against a hand tool.

2. The hand tool frame as claimed in claim 1, wherein
the body has
two front mounting recesses formed in the front side of the body beside the outer rack and paralleling the outer rack;
two rear mounting recesses formed in the rear side of the body corresponding to the front mounting recesses; and
two passing holes formed through the sides of the body near the top of the body and respectively communicating with the front mounting recesses and the rear mounting recesses;
the hanging panel has
a bottom side; and
two connecting blocks formed on and protruding from the bottom side of the hanging panel at an interval and respectively mounted in the rear mounting recesses of the body, and each connecting block having a connecting hole formed through the connecting block and aligning with the passing hole that communicates with the corresponding rear mounting recess; and the front side of each one of the clamping panel extending out of a corresponding front mounting recess.

3. The hand tool frame as claimed in claim 2, wherein the clamping elements are detachably mounted on the body of the baseboard beside the outer rack, and each clamping element has a connecting panel mounted in one of the front mounting recesses and having a top; and a through hole formed through the connecting panel near the top of the connecting panel and aligning with the passing hole that communicates with the corresponding front mounting recess; and a fastener mounted through the through hole of the connecting panel, the passing hole of the corresponding front mounting recess and the connecting hole of the corresponding connecting block to connect the connecting panel and the connecting block of the hanging panel with the body; and each one of the clamping panel is perpendicularly formed on and protrudes from a corresponding connecting panel and extends out of the corresponding front mounting recess.

4. The hand tool frame as claimed in claim 3, wherein the width of the bottom board of each one of the positioning elements is wider than the width of the opening of the outer rack to prevent the bottom board separating from the outer rack via the opening of the outer rack; and the width of the fixing board of each one of the positioning elements is wider than the width of the opening of the inner rack to prevent the fixing board separating from the inner rack via the opening of the inner rack.

5. The hand tool frame as claimed in claim 4, wherein the bottom board of each one of the positioning elements is quadrate; and the fixing board of each one of the positioning elements is quadrate.

6. The hand tool frame as claimed in claim 2, wherein the width of the bottom board of each one of the positioning elements is wider than the width of the opening of the outer rack to prevent the bottom board separating from the outer rack via the opening of the outer rack; and the width of the fixing board of each one of the positioning elements is wider than the width of the opening of the inner rack to prevent the fixing board separating from the inner rack via the opening of the inner rack.

7. The hand tool frame as claimed in claim 1, wherein the width of the bottom board of each one of the positioning elements is wider than the width of the opening of the outer rack to prevent the bottom board separating from the outer rack via the opening of the outer rack; and the width of the fixing board of each one of the positioning elements is wider than the width of the opening of the inner rack to prevent the fixing board separating from the inner rack via the opening of the inner rack.

* * * * *